US005606773A

United States Patent [19]

Shappell

[11] Patent Number: 5,606,773

[45] Date of Patent: Mar. 4, 1997

[54] REVERSIBLE HINGE ASSEMBLY

[75] Inventor: Robert A. Shappell, Hackettstown, N.J.

[73] Assignee: Pike Machine Products, Inc., Elizabeth, N.J.

[21] Appl. No.: 557,611

[22] Filed: Nov. 14, 1995

[51] Int. Cl.[6] ..... E05F 1/08

[52] U.S. Cl. ..... 16/298; 16/301; 16/308; 16/50; 49/386

[58] Field of Search ..... 16/298, 299, 300, 16/301, 295, 278, 279, 285, 289, 290, 304, 307, 308, 49, 50, 72, 75; 49/386, 381, 382

[56] References Cited

U.S. PATENT DOCUMENTS

| | | | |
|---|---|---|---|
| 769,035 | 8/1904 | Walter et al. . | |
| 1,235,407 | 7/1917 | Winder | 16/300 |
| 1,912,289 | 5/1933 | March | 16/300 |
| 2,097,651 | 11/1937 | Stangeland . | |
| 3,331,159 | 7/1967 | Cooke et al. . | |
| 3,339,225 | 9/1967 | Booth . | |
| 3,365,747 | 1/1968 | Barroero . | |
| 3,426,482 | 2/1969 | Mock . | |
| 3,507,074 | 4/1970 | Gallegos . | |
| 3,510,986 | 5/1970 | Berkowitz | 16/300 |
| 3,518,716 | 7/1970 | Larson | 16/50 |
| 3,629,972 | 12/1971 | Rehberg et al. . | |
| 3,965,533 | 6/1976 | Frohlich | 16/300 |
| 4,073,038 | 2/1978 | Curry et al. | 16/301 |
| 4,416,086 | 11/1983 | Niekrasz . | |
| 4,479,623 | 10/1984 | Maraghe et al. . | |
| 4,578,902 | 4/1986 | Niekrasz et al. . | |
| 4,637,167 | 1/1987 | Svennson . | |
| 4,696,078 | 9/1987 | Stromquist . | |
| 4,753,043 | 6/1988 | Beckwinkel . | |
| 5,048,155 | 9/1991 | Hwang . | |
| 5,109,571 | 5/1992 | Ohshima et al. . | |
| 5,125,131 | 6/1992 | Leblanc . | |
| 5,228,240 | 7/1993 | Barroero et al. | 16/308 |
| 5,321,870 | 6/1994 | Wada et al. . | |

FOREIGN PATENT DOCUMENTS

| | | | |
|---|---|---|---|
| 372500 | 3/1923 | Germany | 16/301 |
| 1444556 | 8/1976 | United Kingdom . | |

*Primary Examiner*—Chuck Y. Mah

*Attorney, Agent, or Firm*—Lerner, David, Littenberg, Krumholz & Mentlik

[57] ABSTRACT

A swingable door assembly and a hinge assembly for urging the swingable door assembly to a closed position is provided. The hinge assembly comprises a torsion spring which may be an elongate torsion rod, which may be preloaded with a predetermined amount of torsion force so that the associated swingable door assembly is urged to a closed position with respect to a casing, such as a refrigerated display case. The hinge assembly includes a ratchet pin connected to the torsion spring. First and second ratchet anchors may be mounted at a predetermined distance from each other on the ratchet pin. A fixed ratchet is secured to the ratchet between the first and second ratchet anchors. One of the first and second ratchet anchors is secured to the swingable door assembly while the other one of the ratchet anchors remains unsecured whereby the secured ratchet anchor is free to rotate in one direction relative to the fixed ratchet and the unsecured ratchet anchor upon application of a torsion force to preload the torsion spring.

29 Claims, 6 Drawing Sheets

REVERSIBLE HINGE ASSEMBLY

FIELD OF THE INVENTION

The present invention relates to swingable doors. More particularly, the present invention relates to hinge assemblies including torsion springs for automatically biasing swingable doors to a closed position.

BACKGROUND OF THE INVENTION

Swingable doors are doors which are hinged to a frame structure or otherwise pivot about an axis. Such doors are used in thousands of different applications including homes, office buildings, automobiles, cabinets, display cases, refrigerators, and the like. Inventors have therefore expended great effort to develop and improve swingable doors and hinges for such doors.

It is sometimes desirable to provide a hinge assembly including means for automatically closing an associated swingable door after the door has been opened. For example, when swingable doors are used on refrigerators, it is desirable for the doors to include hinge assemblies which automatically urge them to a closed position. It is particularly desirable to use automatic closing swingable doors for refrigerator display cases in commercial environments as customers often open refrigerator display cases to obtain products stored therein and thereafter walk away from the open refrigerated display case without closing the door.

One type of hinge assembly which is used to automatically urge a swingable door into a closed position includes a torsion rod as part of its structure. Torsion rods permit hinge assemblies to be preloaded with a predetermined amount of torsion force to urge an associated swingable door into its closed position.

In order to accomplish this automatic closing force, a torsion rod may typically be an elongate rod which is fixed at one end and which may be twisted at the other end so that the inherent nature of the material and dimensions of the rod will exert a torsion force after it has been rotated.

Certain refrigerated display cases may use swingable doors which rotate about a hinge assembly in a clockwise direction in order to open the door. Such doors may swing open to the left. In other embodiments, the swingable doors may open in the opposite direction (i.e., to the right) and thus rotate counter clockwise about their hinge axis.

Ratchet assemblies are typically used as part of hinge assemblies to preload a torsion spring and permit rotation in a single direction (i.e., clockwise or counter clockwise) while prohibiting rotation in the other direction. Such ratchet assemblies are known in the art and typically include a pair of ratchets arranged in abutment with each other on a hinge assembly. The abutting ratchets may include meshed-face type teeth which are adapted to permit rotation of the ratchets in either the clockwise or counter clockwise direction with respect to each other, while inhibiting rotation in the other direction.

Certain prior art swingable doors which include preloaded hinge assemblies can be reversed so that they open in an opposite direction from the original swinging direction. Reversal of the swingable doors have heretofore been accomplished upon removal of the doors from their assembled position, flipping the doors over and mounting them on a different side of an associated case.

One type of reversible prior art swingable door includes a relatively large rectangular cut-out area in the sash of the door which is necessary to provide access for an Allen wrench, or other tool which must interact with the hinge assembly in order to accomplish preloading and adjustment. These prior art doors are undesirable because the large cut-out area weakens the door structure.

Another disadvantage of prior art preloaded hinge assemblies is that they are difficult to remove when repairs are necessary. In particular, the entire door frame must be disassembled in order to remove the prior art preloaded hinge assemblies. This process is time consuming and complicated. Further, prior art doors which require at least partial disassembly to remove and replace components of the hinge assembly are limited in their design. To this end, unified bonded glass and frame doors cannot be used with hinge assemblies which are only accessible after disassembly at the door frame.

SUMMARY AND OBJECTS OF THE INVENTION

The present invention solves the problems associated with prior art preloaded hinge assemblies as it provides an easily removable and reinstallable hinge assembly mounted within a swingable door which does not have a large cut-out area in the door sash for preloading or repair of the hinge assembly. The design of the present hinge assembly may be used in swingable doors wherein the glass door pane is rigidly bonded to the frame assembly thereof. This arrangement precludes the necessity for using a weakened structural door frame to permit access to the hinge assembly when it is desired to reverse the opening direction of the associated swingable door.

One aspect of the present invention pertains to a hinge assembly for a swingable door, such as an automatic closing door. The hinge assembly preferably comprises a torsion spring having a first end and a second end. A lower bearing assembly is connected to the first end of the torsion spring. An elongate ratchet pin is connected to the second end of the torsion spring and extends longitudinally away from the torsion spring. The hinge assembly also comprises first and second ratchet anchors mounted at a predetermined distance from each other on the elongate ratchet pin. Each of the first and second ratchet anchors includes at least one end having a plurality of teeth. The hinge assembly also comprises a fixed ratchet having a first end and a second end and is secured to the ratchet pin between said first and second ratchet anchors. Each of the ends of the fixed ratchet may include a plurality of teeth arranged in abutment with the plurality of teeth at respective ends of the first and second ratchet anchors. Securing means are also provided for selectively securing one of the first and second ratchet anchors to the frame extrusion of an associated swingable door while the other ratchet anchor remains unsecured with respect to the door frame whereby said secured one of the first and second ratchet anchors can rotate relative to the fixed ratchet and the unsecured ratchet anchor upon preloading the torsion spring of the swingable door.

The torsion spring is preferably an elongate torsion rod. It may have various configurations including, but not limited to a rectangular or a hexagonal configuration.

It is also preferable for the lower bearing assembly to comprise a drive pin having a first end and a second end wherein the first end is secured in assembled position to a bracket mounted on the frame of the associated swingable door. The second end of the drive pin may include a blind hole having a size and shape to receive the first end of the torsion rod whereby the first end of the torsion rod is secured against rotation during opening and closing of the swingable door. The lower bearing assembly may also comprise a sleeve bearing which is rotatably mounted on the outer diameter of the drive pin. In another preferred embodiment, the lower bearing assembly may comprise a stop plate mounted between the first end of the drive pin and the sleeve bearing for preventing movement of the associated swingable door beyond a predetermined range.

Preferably, the hinge assembly also comprises spring means arranged on the ratchet pin at opposing ends of the first and second ratchet anchors for urging the teeth at opposing ends of the respective first and second ratchet anchors into abutment with the teeth at the first and second ends of the fixed ratchet.

The hinge assembly may comprise first and second washers secured on the ratchet pin at spaced distances from the first and second ratchet anchors respectively. In this preferred embodiment, the spring means may comprise a first compression spring arranged between the first washer and the first ratchet anchor and a second compression spring arranged between the second washer and the second ratchet anchor.

In another preferred embodiment, the abutting teeth of the first and second ends of the fixed ratchet and the adjacent ends of the first and second ratchet anchors are constructed to permit rotation of the secured ratchet anchor in a clockwise or counter clockwise direction with respect to the fixed ratchet while preventing rotation in the other direction. The hinge assembly of the present invention is preferably used with automatic closing swing doors. To this end, preloading means are provided for rotating the second end of the torsion spring while the first end of the torsion spring remains substantially fixed whereby torsion forces are applied to the torsion spring so that the swingable door assembly is urged to a closed position with respect to an associated casing. In a preferred embodiment, the preloading means comprises the combination of a torquing key and a receptacle which is sized and shaped to receive the torquing key. The receptacle is arranged in conjunction with the ratchet pin whereby rotation of the torquing key effects rotation of the ratchet pin and the second end of the torsion spring.

In another preferred embodiment, the securing means may comprise a screw adapted to secure one of the first or second ratchet anchors to the door so that the secured one of the first or second ratchet anchors will rotate relative to the fixed ratchet and the unsecured one of the ratchet anchors upon preloading of the torsion spring. The second ratchet anchor may be considered to be the "active" ratchet anchor while the unsecured ratchet anchor is "inactive". Each of the first and second ratchet anchors may comprise a receiving hole. In this embodiment, the screw of the securing means may be arranged in assembled position within the receiving hole of the selected one of the first or second ratchet anchors to obtain fixation of said selected ratchet anchor with respect to the frame of the swingable door.

In accordance with another aspect of the present invention, a swingable door assembly which is rotatably supported by a casing is provided. The swingable door assembly comprises a top end and a bottom end and an end sash having a longitudinal axis about which the door assembly rotates during opening and closing thereof. The swingable door assembly in accordance with this aspect of the present inventions may include a hinge assembly arranged within the end sash comprising various features discussed herein.

A novel aspect of the hinge assembly of the present invention pertains to the ratchet assembly thereof. To this end, the ratchet assembly may comprise three ratchet components and a pin which extends through a central bore of each of the ratchet components. A pair of compression springs are used to keep all three of the ratchet components in engagement with each other. The three ratchet components comprise a pair of spaced ratchet anchors having ramped teeth on at least one side thereof, and a fixed ratchet arranged between the spaced ratchet anchors. The fixed ratchet includes a plurality of ramped teeth at both ends thereof and is arranged for rotatable engagement with a selected one of the ratchet anchors.

The basic function of the ratchet components is typical of the state of the art where two ratchet components having ramped teeth on mating faces are used. Namely, to rotate a shaft in one direction but to prevent rotation of the shaft in the opposite direction.

A unique aspect of the ratchet components of the present ratchet assembly is that it has three ratchet components (i.e., two ratchet anchors and a centrally arranged fixed ratchet) which act in conjunction with each other to perform the basic function discussed above.

The purpose of the ratchet assembly of the present invention is to allow an associated torsion rod to be rotated at one end (where it may be attached to associated swingable door) during preloading of the torsion rod while the other end of the torsion rod is attached to the display case (which may be accomplished through a drive pin and a bracket). Rotation of the torsion rod during preloading may be accomplished in one direction due to the operative engagement of the ramped teeth on the mating faces of the fixed ratchet and one of the ratchet anchors.

During operation of the present invention, one of the two ratchet anchors will be fixed to the swingable door frame. This ratchet anchor may be considered the secured ratchet anchor and may also be considered the "active" ratchet anchor in combination with the fixed ratchet. To this end, the secured ratchet anchor and the fixed ratchet combine to perform ratcheting action in accordance with the basic ratchet function discussed above. The unsecured ratchet anchor (i.e., the inactive ratchet component) will rotate along with the fixed ratchet due to the engaged mating teeth on adjacent surfaces of the fixed ratchet and the unsecured ratchet anchor. When it is desired to reverse the opening direction (i.e., the pivoting direction) of an associated swingable door, the ratchet anchor that was previously considered the secured ratchet anchor will become the unsecured ratchet anchor and vice versa.

If ratcheting for a right hand pivot is desired, the top ratchet anchor will be secured to the frame of the associated swingable door. In this embodiment, the combination of the fixed ratchet and the secured top ratchet anchor will constitute the active ratchet components. If ratcheting for a left hand pivot is desired, the bottom ratchet anchor will be secured to the door frame. In this embodiment, the combination of the fixed ratchet and the secured bottom ratchet anchor will constitute the "active" ratchet components.

It is an object of the present invention to provide a swingable door including a hinge assembly which will facilitate simple reversal of the swingable door.

It is another object of the present invention to provide an automatic closing swingable door having a durable bonded structure.

It is a further object of the present invention to provide an automatic closing swingable door having a hinge assembly which can be easily and quickly removed for reversal of the door, and repair and/or replacement of the hinge assembly if necessary.

It is yet another object of the present invention to provide a swingable door having a hinge assembly which can be easily and quickly preloaded through a hidden access opening at the top of the door sash. This hidden opening will also prevent tampering with the hinge assembly.

The aforementioned objects, advantages and other features of the present invention will be more readily understood when read in conjunction with the following detailed description of the preferred embodiments and drawings.

DETAILED DESCRIPTION OF THE PREFERRED EMBODIMENTS

Figure 1:
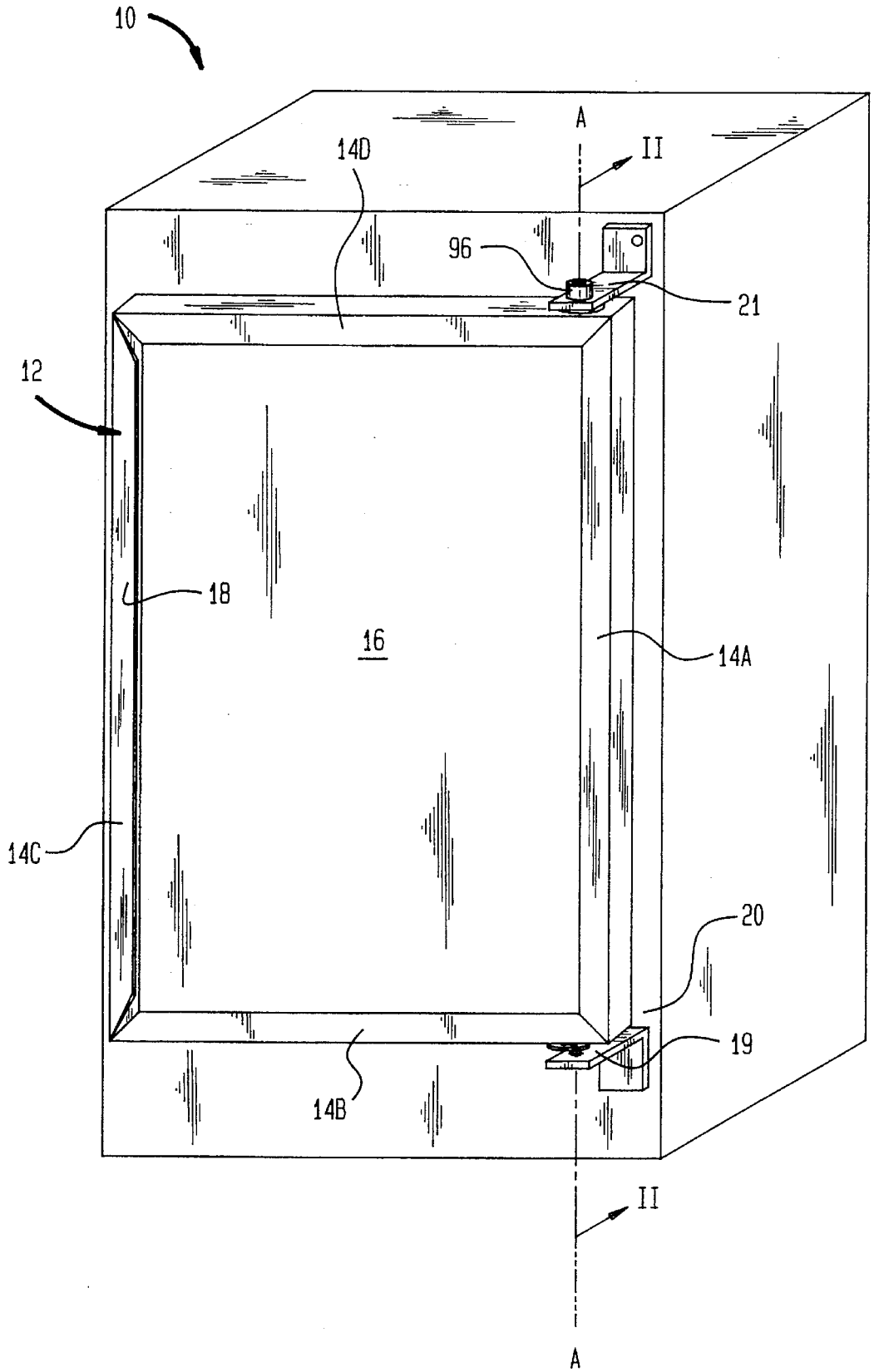
FIG. 1 is a perspective view of a refrigerated display case including a swingable door assembly in accordance with the present invention.

A refrigerated display case 10 including a swingable door 12 in accordance with the present invention is shown in FIG. 1. The refrigerated display case 10 may be the type often used in commercial establishments such as restaurants, supermarkets, convenience stores and the like. It should be understood that the refrigerated display case shown in FIG. 1 has been selected by way of example for use with swingable door 12 and hinge assembly 24 (shown in FIGS. 2–5) of the present invention. To this end, the swingable door 12 each includes the hinge assembly 24 and can be used to enclose various rooms, cabinets, compartments, appliances and other areas.

As shown in FIG. 1, swingable door 12 will open when pivoted in a counter clockwise direction about a longitudinal axis A—A extending through hinge assembly 24 (not shown in FIG. 1) and the outermost side 14A of door sash 14A–D. Swingable door 12 can also be considered a right-hand swingable door.

Figure 2:
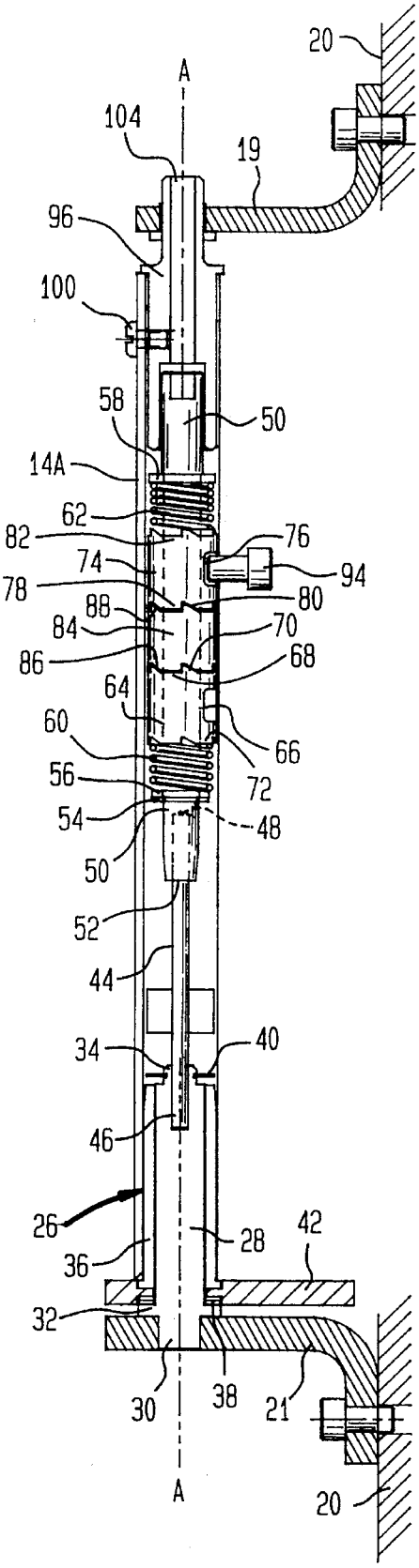
FIG. 2 is a cut away view of a hinge assembly and swingable door taken along line II—II of FIG. 1.

As also shown in FIGS. 1 and 2, swingable door 12 includes a glass pane 16 arranged within the perimeter of the door frame denoted by sashes 14A–D. The swingable door 12 also includes a handle 18 and is rotatably mounted on lower and upper brackets 19 and 21 which are connected to the frame 20 of the refrigerated display case 10. It should be appreciated that the swingable door 12 can be secured to the frame 20 of the refrigerated display case 10 in various ways known in the art, besides the preferred use of brackets shown in FIGS. 1–2.

Figure 4:
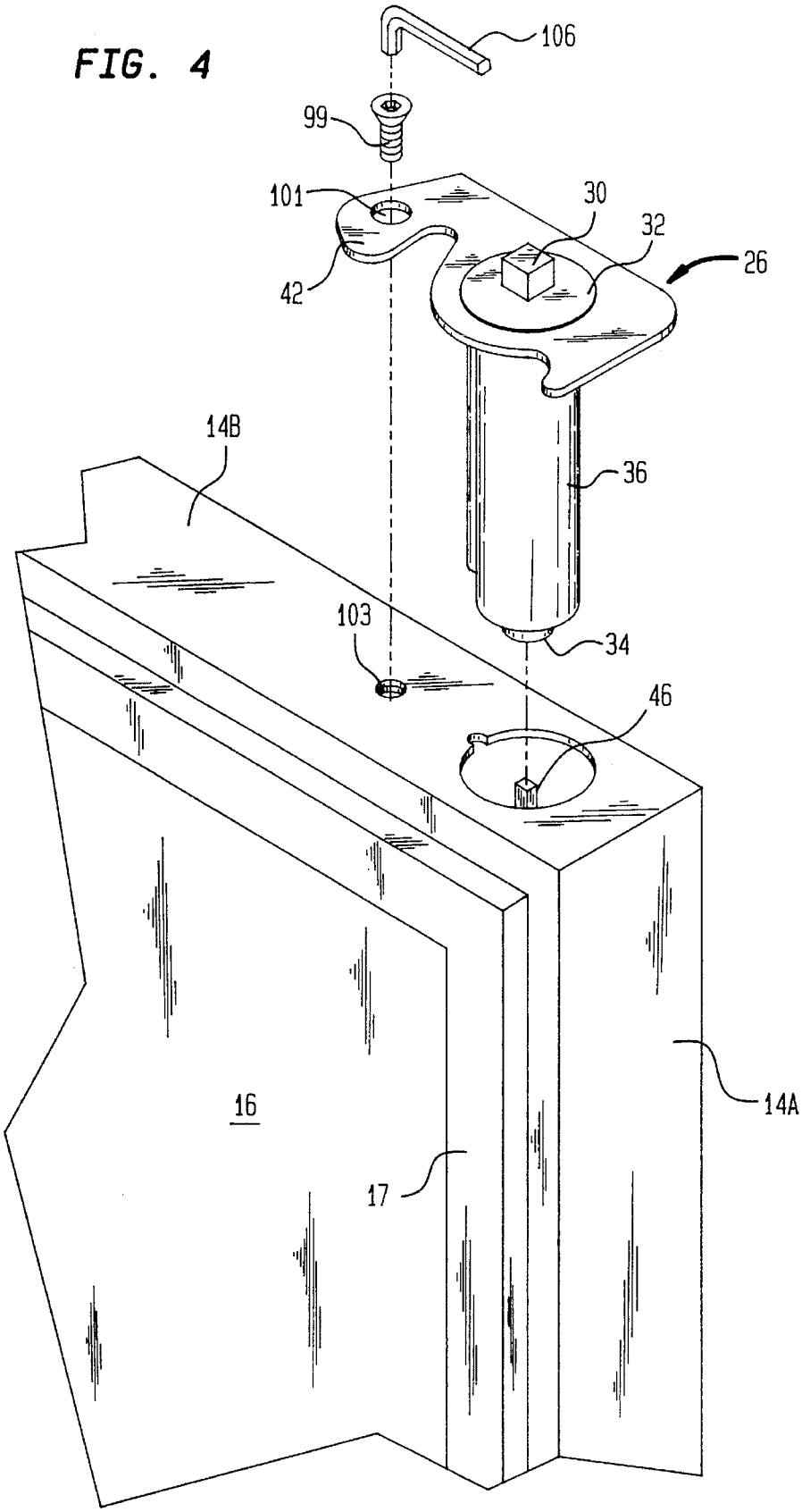
FIG. 4 is a bottom plan partially exploded view of the swingable door and the lower bearing assembly removed from the display case shown in FIG. 1.
Figure 5:
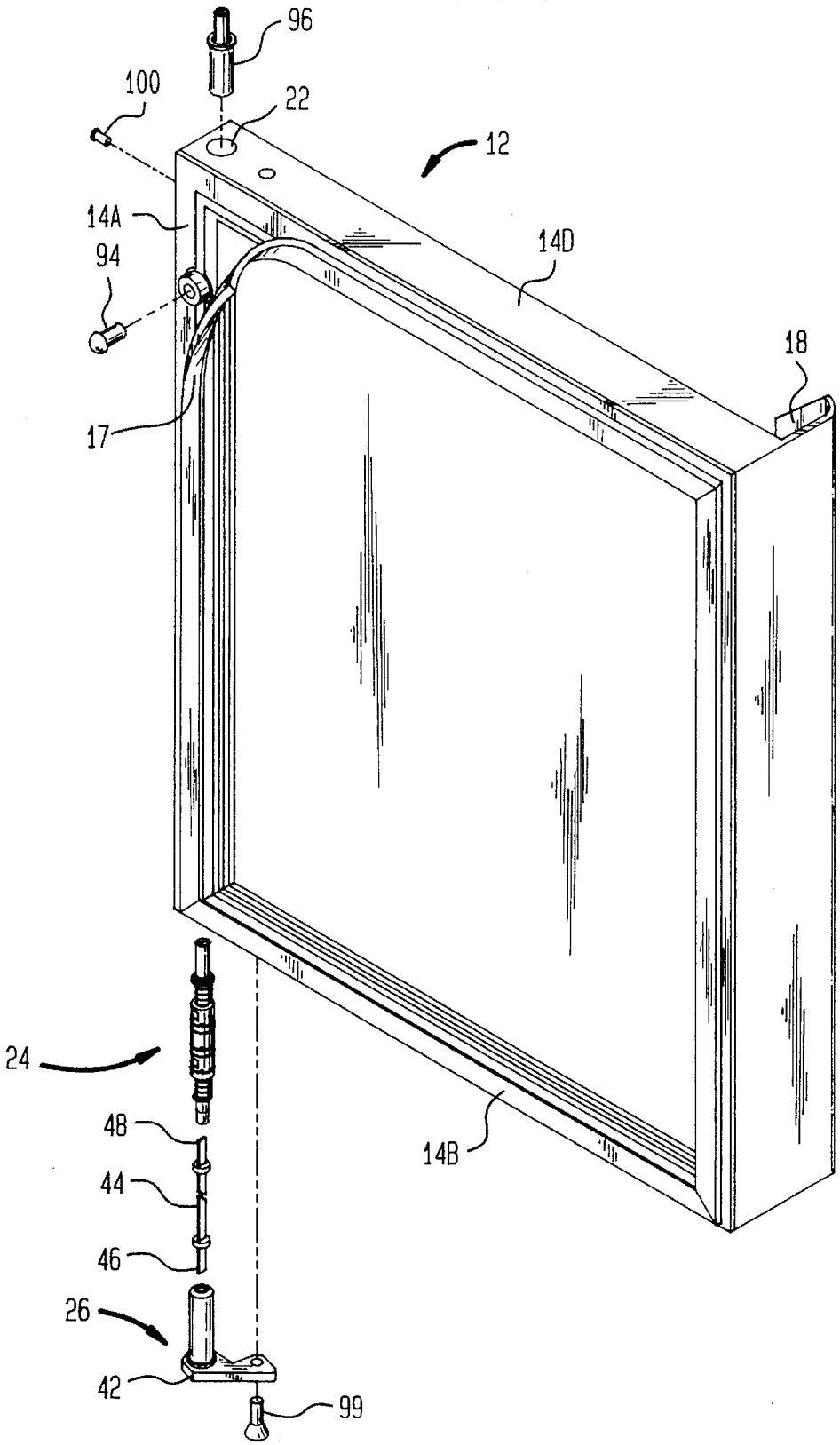
FIG. 5 is a partially exploded perspective view of the hinge assembly removed from the sash of the swingable door as illustrated from the rear side.
Figure 6:
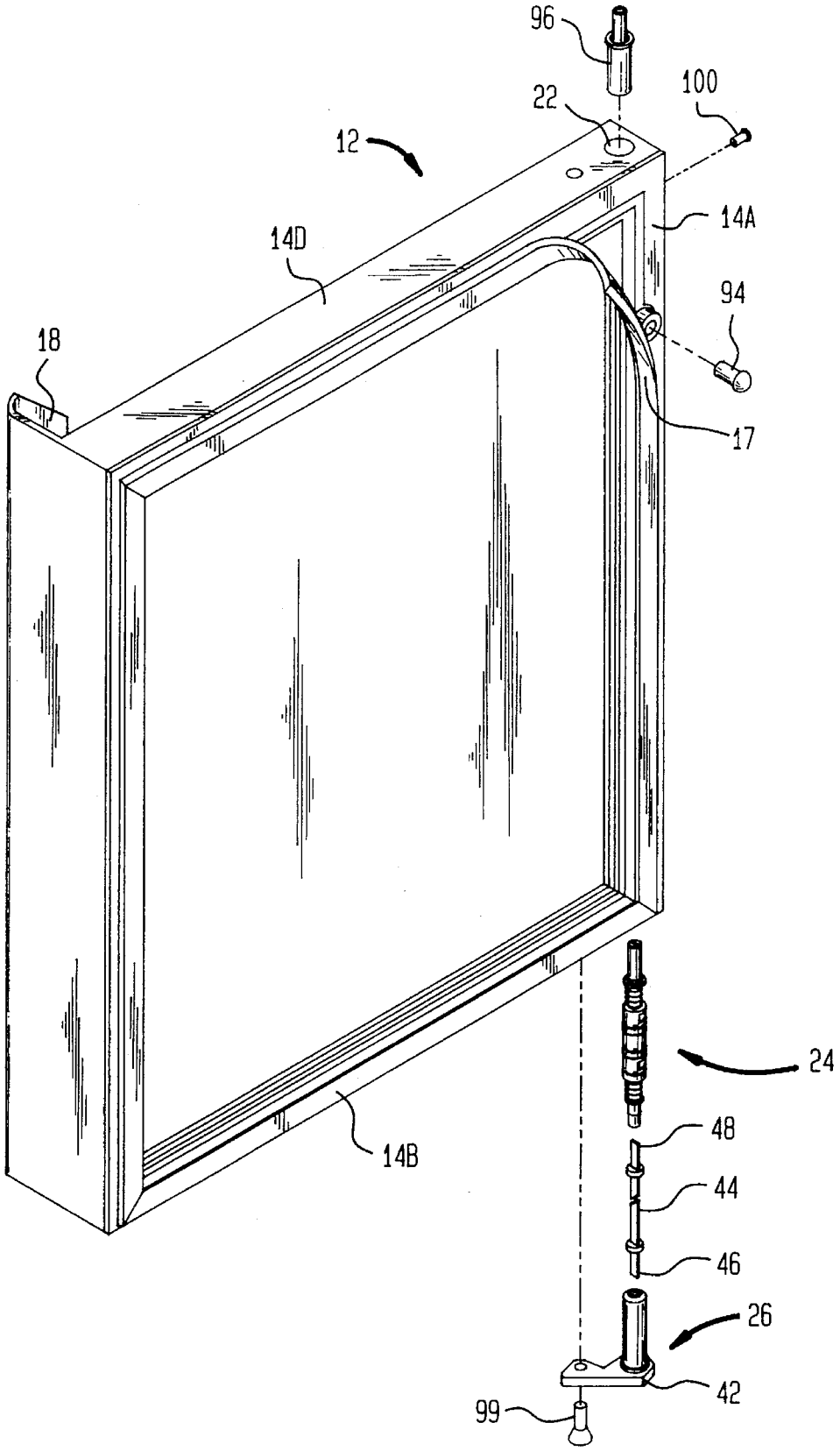
FIG. 6 is a similar partially exploded perspective view to that shown in FIG. 5 with the door assembly flipped upside down for reverse operation.

In assembled position, the hinge assembly 24 is mounted within the outermost sash 14A of swingable door 12. The hinge assembly 24 can be removed and reinstalled through access openings 22 arranged at the top and bottom of the outermost door sash as shown in FIGS. 4–6. This aspect of the present invention will be discussed in more detail below.

Swingable door 12 is an automatic closing door which is particularly desirable when used on commercial or residential refrigerators. The term "automatic closing" door refers to swingable doors which include a mechanism that constantly biases the associated door to a closed position. For example, if swingable door 12 is pulled to an open position with respect to the refrigerated display case 10, and is thereafter released without applying any external closing force, the swingable door 12 would be automatically biased to a closed position by the hinge assembly 24.

As shown in FIG. 2, the hinge assembly 24 includes a lower bearing assembly 26 which is secured within lower bracket 21 when in assembled position. The lower bracket 21 is connected to the frame 20 of the refrigerated display case 10. The lower bearing assembly 26 may also be secured by other conventional means to the frame or other enclosure associated with the swingable door 12. In the preferred embodiment of the present invention shown in FIGS. 2 and 4–6, the lower bearing assembly 26 includes a drive pin 28, which may have a square configuration at its bottom-most end 30. The square configuration of the bottom end 30 of the drive pin 28 permits the hinge assembly 24 to be securely mounted in assembled position within the lower bracket 21 on the frame 20 of the refrigerated display case 10.

A shoulder 32 extends peripherally around the drive pin 28 at a location immediately above the square bottom end 30 to stabilize mounting of the hinge assembly 24 within the lower bracket 21 on the frame 20 of the display case 10 as clearly illustrated in FIG. 2. The top end 34 of the drive pin 28 includes a receptacle 34, which may have a square perimeter, or other shaped perimeter for securely retaining torsion rod 44 as discussed further below.

The lower bearing assembly 26 also includes a sleeve bearing 36 which is rotatably fixed in outermost sash 14A when in assembled position on the drive pin 28. A thrust washer 38 may be arranged immediately above the fixed shoulder 32 of the drive pin 28 for facilitating rotation of a stop plate 42. The sleeve bearing 36 is retained in assembled position on the drive pin 28 between the top side of the stop plate 42 and a locking device such as E-ring 40 which is arranged adjacent to the top end 34 of the drive pin 28.

As shown in FIGS. 2–6, the hinge assembly 24 is mounted within the outermost sash 14A of swingable door 12 along the entire length between the top and bottom sides thereof. The square bottom end 30 of the drive pin 28 and the stop plate 42 is arranged external to the swingable door 12 between the bottom end thereof and the frame 20 of the refrigerated display case 10. This arrangement permits rotatable movement of the swingable door 12.

The swingable door 12 is constantly biased to a closed position by a force created upon twisting of the torsion rod 44 of the hinge assembly 24. The torsion rod 44 is one type of torsion spring which can be used as part of hinge assembly 24. In a preferred embodiment, the torsion rod 44 may have an elongate rectangular or hexagonal configuration. The cross sectional dimension of one preferred torsion rod is about 0.130 inches×0.130 inches. However, it should be appreciated that torsion rods having dimensions larger and smaller than the preferred embodiment discussed herein may be used in accordance with the present invention.

Torsion rod 44 includes a bottom end 46 which is secured within the square blind hole receptacle 34 at the top of the drive pin 28 when arranged in assembled position as shown in FIGS. 2, 5 and 6. The top end 48 of the torsion rod 44 is secured for rotatable movement along with ratchet pin 50 within the square blind hole receptacle 52 at the bottom end of the ratchet pin 50.

In order to preload the hinge 24 so that the constant closing force will be imparted to an associated swingable door, one end of the torsion rod 44 must be rotated while the other end remains fixed. This will produce a torsional force due to the inherent material characteristics and dimensions of the torsion rod. To this end, the torsional force that is produced and stored in torsion rod 44 is a function of the material composition of the torsion rod as well as the length, width and initial twisting force applied. In a preferred embodiment where the swingable door 12 has an overall length of about sixty-five inches extending in the direction of a longitudinal axis through the outermost door sash 14A, the torsion rod 44 may be about fifty inches long. It may be made of low or high tensile material, but is preferably made of a high tensile material such as chrome silicon ASTM A401. As will be discussed further below, preloading of the torsion rod 44 may be accomplished by retaining the bottom end 46 in a fixed state within the drive pin receptacle 34 while the top end 48 of the torsion rod 44 is rotated along with the ratchet pin 50 upon application of a preloading force.

Figure 3:
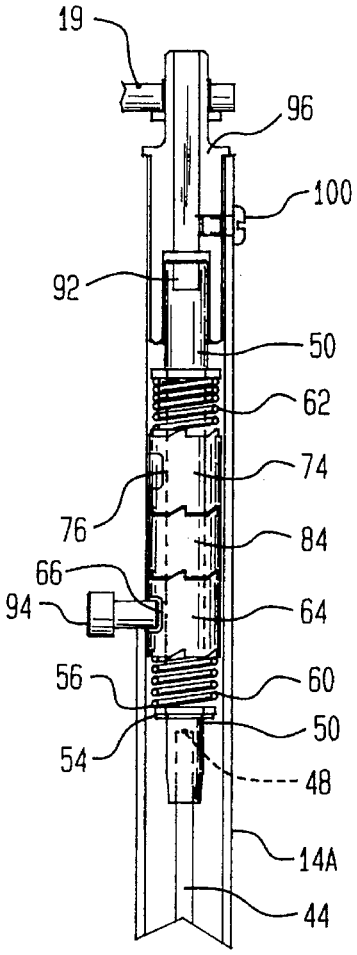
FIG. 3 is a partially cut away view of the hinge assembly and the swingable door shown in FIGS. 1 and 2 after its pivoting direction has been reversed.

The ratchet pin 50 of the hinge assembly 24 extends upwardly from the torsion rod 44 toward the top of the associated swingable door. A snap ring 54 is arranged on the ratchet pin 50 to support a bottom washer 56. A top washer 58 is spaced from the bottom washer 56 as best shown in FIGS. 2–3. A pair of compression springs including bottom compression spring 60 and top compression spring 62 are mounted on the ratchet pin 50 adjacent the bottom washer 56 and the top washer 58, respectively.

The hinge assembly 24 also includes a pair of ratchet anchors 64 and 74 spaced at a predetermined distance from each other as shown in FIGS. 2, 3, 5 and 6. The first ratchet anchor 64 is shown as a bottom ratchet anchor in a preferred embodiment and includes a recess 66 for selectively receiving a retaining screw 94 when it is desirable to secure the bottom ratchet anchor 64 to the outermost sash 14A of swingable door 12. This arrangement is used when a left hand hinged door pivot is desired. The retaining screw 94 can also be used to secure the second ratchet anchor 74, shown as a top ratchet anchor 74, to the outermost door sash 14A of swingable door 12 when a right hand hinged door pivot is desired. The ratchet pin 50 includes a hexagonal shaped receptacle 92 at the top end 90 thereof. This aspect of the present invention will be discussed in more detail below in connection with the operation of the hinge assembly 24 upon opening or closing of the swingable door 12. The top end 68 of the bottom ratchet anchor 64 includes a plurality of teeth 70 which are in abutment with cooperating teeth 86 of fixed ratchet 84. The bottom end 72 of the bottom ratchet anchor 64 abuts the bottom compression spring 60, which urges the bottom ratchet anchor 64 upwardly against fixed ratchet 84.

The top ratchet anchor 74 is identical to the bottom ratchet anchor 64 as it includes a recess 76 for receiving the retaining screw 94, a bottom end 78, a plurality of teeth 80 arranged at the bottom end thereof, and a top end 82 arranged in abutment against compression spring 62 which urges the top ratchet anchor 74 downwardly so that the teeth 80 at the bottom end thereof firmly abut the corresponding teeth 88 at the top end of the fixed ratchet 84. The operative arrangement between the teeth of the top and bottom of ratchet anchors 64 and 74, and the teeth 86 and 88 of fixed ratchet 84 permit rotation of the top end 48 of the torsion rod 44 in order to preload the torsion rod 44 in one direction only so that the associated swingable door 12 will be biased to a closed position when it is mounted between the top and bottom brackets 19 and 21, which are secured to the frame 20 of the refrigerated display case 10.

A top pivot assembly 90 is mounted within the hexagonal shaped receptacle 92 at the top 88 of ratchet pin 50. A channel (not numbered) extends into the top pivot assembly 96 for receiving a screw 100 which may be used to facilitate securing of the hinge assembly 24 within the outermost sash 14A of swingable door 12.

Figure 7:
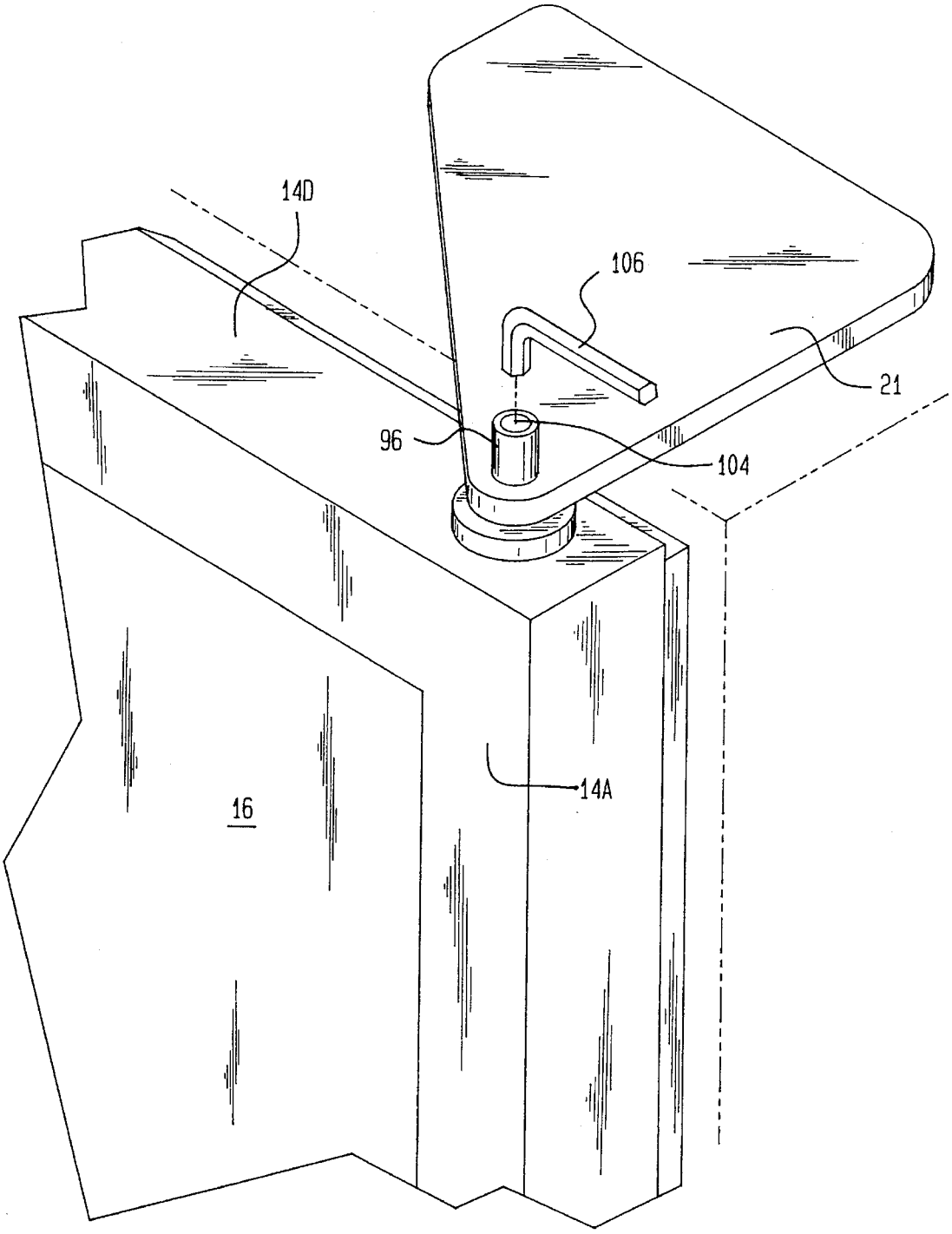
FIG. 7 is a perspective elevational view of a swingable door in combination with a hex key for preloading the hinge assembly of the present invention.

As best shown in FIG. 7, the top pivot assembly 96 includes a hexagonal shaped wrench 106 which is adapted to be inserted within the hexagonal shaped receptacle 92 at the top end 90 of the ratchet pin 50. A key receiving channel 104 is sized and shaped to receive the hexagonal wrench 106 as it extends through the access opening 22 at the top of the door sash 14D so that the hinge assembly 24 can be preloaded with a desired torsional force.

The structure of the hinge assembly 24 is particularly advantageous for facilitating reverse pivoting of the swingable door 12. The term "reverse pivoting" means that the swingable door 12 is flipped over and may be arranged on brackets (not shown) mounted on the left side of the refrigerated display case shown in FIG. 1. Swingable door will then open in the opposite direction so that it will rotate in a clockwise direction about hinge assembly 24 (i.e., a left hand door pivot) when pulled to an open position.

A stop plate 42 of the lower bearing assembly 26 is connected to the bottom sash 14B of swingable door 12. As illustrated in FIGS. 4–6, this may be accomplished by placing securing screw 99 through passageway 101 in the stop plate 42 and corresponding threaded passageway 103 in the bottom sash 14B of swingable door 12.

Removal of the lower bearing assembly 26, or any component thereof, may easily be accomplished by first removing screw 99 from its secured position within threaded passageway 103 and passageway 101. Screw 99 may be removed in any conventional manner such as through the use of a hex key (shown in FIG. 4), a screwdriver or the like. Since the bottom end 46 of the torsion rod 44 is not fixed within the sized and shaped receptacle 34 at the top end of drive pin 28, the entire lower bearing assembly 26 can be pulled off of torsion rod 44 and out of access opening 22 after screw 99 has been removed.

In a preferred embodiment, the swingable door 12 may include an insulating gasket 17 mounted around the frame perimeter (i.e., the perimeter of door sashes 14A–D). The gasket 17 may serve the purpose of sealing the space between the cabinet of the refrigerated display case 10 and the perimeter of the door frame so that cold air will not escape from the refrigerated display case 10 when the swingable door 12 is in a closed position. The gasket 17 may also serve the purpose of covering ratchet screw 94 when in assembled position between the outermost door sash 14 and the selected one of the recesses 66 and 76 in corresponding ratchet anchors 64 and 74.

When it is desired to reverse the opening (i.e., pivoting) direction of swingable door 12, hinge assembly 24 must be removed from its assembled position within the outermost sash 14A. As best explained with reference to FIGS. 4–7, this can easily be accomplished by first removing swingable door 12 from its assembled position on the lower and upper brackets 19 and 21, which are secured to the frame 20 of refrigerated display case 10. After swingable door 12 has been removed from its assembled position, stop plate screw 99 should be removed from threaded passageway 103 by using a hex key or screwdriver as discussed above. The gasket 17 should be peeled away from the outermost door sash 14A in the location where it extends over ratchet anchor screw 94. In the embodiment shown in FIG. 1, swingable door 12 is pivoted counterclockwise about hinge assembly 24 as it is a right hand pivoting door. Accordingly, ratchet screw 94 must be removed from its assembled position within the recess 76 of the top ratchet anchor 74.

The lower bearing assembly 26 should then slide out of the bottom access opening 22 as illustrated in FIG. 4. The bottom end 46 of the torsion rod 44 will then be exposed and should be removed through bottom access opening 22 by using a needle nose pliers, or the like. The ratchet pin 50 and all components secured thereto including washers 56 and 58, compression springs 60 and 62, ratchet anchors 64 and 74 and fixed ratchet 84 can then be removed.

The top pivot assembly 96 is secured to the swingable door 12 by screw 100 as illustrated in FIGS. 2, 3, 5 and 6. Screw 100 should then be removed from its assembled position in the outermost sash 14A so that the top pivot assembly 96 can be removed from the door sash 14D from its assembled position within top access opening 22. In order to facilitate removal of the top pivot assembly 96, a dowel rod (not shown), which is slightly longer than the length of swingable door 12 may be inserted through bottom access opening 22 within bottom sash 14B and the top pivot assembly 96 can then be tapped out of the top access opening 22.

At this point, all of the components of the hinge assembly 24 have been removed from assembled position within the outermost sash 14A. Swingable door 12 is shown with the components in FIG. 5 of hinge assembly 24 removed while in an upright position.

Swingable door 12 should then be rotated end-to-end so that the end of the door sash which was previously the bottom end when mounted in the position shown in FIG. 1, will now be the top end. This orientation can be appreciated from FIG. 6. The component parts of the hinge assembly 24 should then be reinstalled within the outermost sash 14A through the new top access opening 22, which was previously the bottom access opening.

A preferred sequence of reinstallation is as follows. First, top pivot assembly 96 should be placed through top access opening 22. The top pivot assembly 96 may have a press fit relationship with the perimeter of access opening 22. In this embodiment, the top pivot assembly 96 may be tapped into place with an external object, such as a rubber mallet. The screw 100 should then be reinserted through the outermost door sash 14A so that it extends perpendicular to the longitudinal access of the top pivot assembly 96 so that the top pivot assembly 96 can be secured in assembled position. The ratchet pin 50 and the components secured thereon including top and bottom ratchet anchors 64 and 74, fixed ratchet 84, compression springs 60 and 62 and washers 56 and 58 should be placed into the outermost sash 14A through the bottom access opening 22. This can easily be accomplished by first placing the end 48 of torsion rod 44 into the receptacle 52 of the ratchet pin 50. The ratchet pin assembly can then be pushed upwardly along the channel within the outermost sash 14A until it bottoms out upon contacting the top pivot assembly 96. The ratchet screw 94 should be inserted into the recess 66 of ratchet anchor 64 and tightened so that the bottom ratchet anchor 64 is secured to the outermost sash 14A. In this orientation, the bottom ratchet anchor 64 is the "secured" ratchet anchor. The combination of the fixed ratchet 84 and the secured bottom ratchet 64 will constitute the "active" ratchet components.

When swingable door 12 is hinged on the left side of refrigerated display case 10, the bottom ratchet anchor 64 is the "secured" ratchet anchor and the swingable door 12 will rotate clockwise about the hinge assembly 24. If swingable door 12 is now effectively converted to a right hand opening swingable door, it will rotate counter clockwise about hinge assembly 24. In this embodiment, it is the combination of the fixed ratchet 84 and the secured top ratchet 74 which constitute the "active" ratchet components.

The gasket 17 should then be pressed back down into assembled position so that it covers the ratchet screw 94. Lower bearing assembly 26 should then be reinserted through the bottom access opening 22 and the stop plate screw 99 should then be reinstalled to lock the stop plate 42 in assembled position on the bottom portion of the door sash. The swingable door 12B can then be remounted on the brackets 19 and 21 so that it will be in assembled position with respect to the frame 20 of refrigerated display case 10.

The hinge assembly 24 of the swingable doors can easily be preloaded by placing the hex key 106 into the receiving hole 104 of the top pivot assembly 96. The hex key 106 should then be rotated in an appropriate direction to preload the associated hinge assembly 24. If the hinge assembly 24 is on the right (as shown in FIG. 1) the hex key 106 should be rotated counterclockwise in order to accomplish preloading. Conversely, if the hinge assembly 24 is arranged on the left side of a refrigerated display case (not shown) the hex key should be rotated clockwise in order to accomplish preloading of the torsion rod 44.

The swingable door 12 should be preloaded to the required number of "clicks" so that the door closes and seals from that position. The maximum rating of the torsion rod 44 may vary in different embodiments. In a preferred embodiment, the torsion rod may be preloaded to a maximum of seventy five inch pounds when the door is an open position. The maximum torsion force will be a function of the length of the torsion rod 44, the material of which the torsion rod 44 is made and the cross sectional area of the torsion rod as discussed above.

As can be appreciated from the orientation of the swingable door 12 in FIGS. 5 and 6, the ratchet anchor screw 94 can be mounted within one of two spaced channels (not numbered) extending perpendicular to the door sash 14A at the top or bottom end of the rear side of the swingable door 12. In particular, the channels which extend within the door sash 14A for receiving ratchet anchor screw 94 in FIGS. 5 and 6 are arranged at predetermined distances from sashes 14B and 14D so that they will line up with a selected recess within the bottom and top ratchet anchors. For example, the insert for the channel shown in FIG. 5 is aligned with the recess 66 in bottom ratchet anchor 64 when a left handed door pivot is desired. Similarly, the insert for the channel shown in FIG. 6 is at the other end of the outermost sash 14A for receiving ratchet anchor screw 94 and is arranged at a predetermined distance from sash 14B so that it will precisely line up with the recess 76 of top ratchet anchor 74 when it is desired to obtain a right handed pivoting door.

The structure and operation of the present swingable door including the hinge assembly 24 provides for simple reversibility of the swingable door 12 while also providing increased durability over known prior art assemblies. Further, if repairs or replacement of the hinge assembly 24 is required, the hinge assembly 24 can be removed quickly without disassembly of the associated swingable door glass as has been required in the prior art.

It should be appreciated that many variations in the structure of the aforementioned hinge assembly and swingable door may fall within the confines of the present invention. To this end, various modifications may be incorporated into the dimensions, materials and type of components of the present hinge assembly and swingable door while remaining within the spirit and scope of the present invention. Accordingly, the present invention is not intended to be limited by the above-stated description as it is defined only by the claims set forth below.

What is claimed is:

1. A hinge assembly for a swingable door, said hinge assembly comprising: a torsion spring; a ratchet assembly including an elongate ratchet pin connected to said torsion spring; first and second ratchet anchors mounted at a predetermined distance from each other on said elongate ratchet pin, each of said first and second ratchet anchors including at least one end having a plurality of teeth; a fixed ratchet having a first end and a second end and being secured to said ratchet pin between said first and second ratchet anchors, said first and second ends of said fixed ratchet having a plurality of teeth arranged in abutment with said teeth at respective ends of said first and second ratchet anchors; and securing means for selectively securing one of said first and second ratchet anchors to an associated swingable door while the other one of said first and second ratchet anchors remains unsecured with respect to the door whereby said secured one of said first and second ratchet anchors will rotate relative to said fixed ratchet upon preloading of said torsion spring.

2. The hinge assembly of claim 1 further comprising preloading means for applying a torsion force to said torsion spring whereby said torsion force is applied to said torsion spring so that the associated swingable door is urged to a closed position.

3. The hinge assembly of claim 1 wherein said securing means comprises a screw adapted to secure one of said first or second ratchet anchors to the associated swingable door so that said secured one of said first or second ratchet anchors can rotate relative to said fixed ratchet and the unsecured one of said first and second ratchet anchors upon opening and closing of the door.

4. The hinge assembly of claim 3 wherein each of said first and second ratchet anchors comprises a receiving port, said screw being arranged within said receiving port of a selected one of said first or second ratchet anchors to define said secured ratchet anchor.

5. A hinge assembly for a swingable door, said hinge assembly comprising: a torsion spring having a first end and a second end; a lower bearing assembly connected to said first end of said torsion spring; an elongate ratchet pin connected to said second end of said torsion spring and extending longitudinally away from said torsion spring; first and second ratchet anchors mounted at a predetermined distance from each other on said elongate ratchet pin, each of said first and second ratchet anchors including at least one end having a plurality of teeth; a fixed ratchet having a first end and a second end and being secured to said ratchet pin between said first and second ratchet anchors, said first and second ends of said fixed ratchet having a plurality of teeth arranged in abutment with said plurality of teeth at respective ends of said first and second ratchet anchors; and securing means for selectively securing one of said first and second ratchet anchors to an associated swingable door while the other one of said first and second ratchet anchors remains unsecured with respect to the door whereby said secured one of said first and second ratchet anchors can rotate relative to said fixed ratchet upon preloading of said torsion spring.

6. The hinge assembly of claim 5 wherein said torsion spring is an elongate torsion rod.

7. The hinge assembly of claim 6 wherein said torsion rod has a rectangular configuration.

8. The hinge assembly of claim 6 wherein said lower bearing assembly comprises a drive pin having a first end and a second end, said first end being secured in assembled position to a casing associated with the swingable door, said second end including a recess having a perimeter sized and shaped to receive said first end of said torsion rod whereby said first end of said torsion rod is secured against rotation during opening and closing of the swingable door.

9. The hinge assembly of claim 8 wherein said lower bearing assembly further comprises a sleeve bearing rotatably mounted on said drive pin.

10. The hinge assembly of claim 9 wherein said lower bearing assembly further comprises a stop plate mounted between said first end of said drive pin and said sleeve bearing for preventing movement of the associated swingable door beyond a predetermined range.

11. The hinge assembly of claim 5 further comprising spring means arranged on said ratchet pin at opposing ends of said first and second ratchet anchors for urging said first and second ratchet anchors into abutment with said first and second ends of said fixed ratchet.

12. The hinge assembly of claim 11 further comprising first and second washers secured on said ratchet pin at spaced distances from said first and second ratchet anchors respectively, said spring means comprising a first compression spring extending between said first washer and said first ratchet anchor and a second compression spring arranged between said second washer and said second ratchet anchor.

13. The hinge assembly of claim 5 wherein said abutting teeth of said first and second ends of said fixed ratchet and said adjacent ends of said first and second ratchet anchors are constructed to permit rotation of said secured one of said first and second ratchet anchors in a clockwise or counterclockwise direction with respect to said fixed ratchet while preventing rotation in the other direction.

14. The hinge assembly of claim 5 further comprising preloading means for rotation of said second end of said torsion spring while said first end of said torsion spring remains substantially fixed whereby a torsion force is applied to said torsion spring so that the swingable door is urged to a closed position.

15. The hinge assembly of claim 14 wherein said preloading means comprises the combination of a torquing key and a receptacle sized and shaped to receive said torquing key arranged in conjunction with said ratchet pin whereby rotation of said torquing key effects rotation of said ratchet pin and second end of said torsion spring.

16. The hinge assembly of claim 5 wherein said securing means comprises a screw adapted to secure one of said first or second ratchet anchors to said door so that said secured one of said first or second ratchet anchors can rotate relative to said fixed ratchet and the unsecured one of said first and second ratchet anchors upon opening and closing of the door.

17. The hinge assembly of claim 16 wherein each of said first and second ratchet anchors comprises a receiving port, said screw being arranged within said receiving port of a selected one of said first or second ratchet anchors.

18. A swingable door assembly rotatably supported by a casing, said swingable door assembly comprising a top end and a bottom end and a end sash having an axis about which the door assembly rotates during opening and closing thereof, said swingable door assembly including a hinge assembly arranged within said end sash, said hinge assembly comprising a torsion spring having a first end and a second end and a longitudinal axis extending through said first and second ends; a lower bearing assembly mountable on said casing below said bottom end of said door sash and extending into said door sash where it is connected to said first end of said torsion spring; a ratchet pin secured to said second end of said torsion spring and extending away from said torsion spring along said longitudinal axis thereof; first and second ratchet anchors mounted at a predetermined distance from each other on said ratchet pin, each of said first and second ratchet anchors including at least one end having a plurality of teeth; a fixed ratchet having a first end and a second end and being secured to said ratchet pin between said first and second ratchet anchors, said first and second ends of said fixed ratchet having a plurality of teeth arranged in abutment with said plurality of teeth at respective ends of said first and second ratchet anchors; preloading means for applying a torsion force to said torsion spring upon rotation of said second end of said torsion spring while said first end of said torsion spring remains substantially fixed whereby a torsion force is applied to said torsion spring so that said swingable door assembly is urged to a closed position with respect to said casing; and securing means for selectively securing one of said first and second ratchet anchors to said swingable door assembly while the other one of said first and second ratchet anchors remains unsecured with respect to said swingable door assembly whereby said secured one of said first and second ratchet anchors can rotate relative to said fixed ratchet anchor and said unsecured ratchet anchor upon application of said torsion force to preload said torsion spring.

19. The swingable door assembly of claim 18 wherein said torsion spring is an elongate torsion rod.

20. The swingable door assembly of claim 19 wherein said torsion rod has rectangular configuration.

21. The swingable door assembly of claim 19 wherein said lower bearing assembly comprises a drive pin having a first end and a second end, said first end being arranged in assembled position within the door frame, said second end including a recess having a perimeter sized and shaped to receive said first end of said torsion rod whereby said first end of said torsion rod is secured against rotation during opening and closing of said swingable door.

22. The swingable door assembly of claim 21 wherein said lower bearing assembly further comprises a sleeve bearing rotatably mounted on said drive pin.

23. The swingable door assembly of claim 22 wherein said lower bearing assembly further comprises a stop plate mounted between said first end of said drive pin and said sleeve bearing for preventing movement of the door beyond a predetermined range.

24. The swingable door assembly of claim 18 further comprising spring means arranged on said ratchet pin at opposing ends of said first and second ratchet anchors for urging said first and second ratchet anchors into abutment with said first and second ends of said fixed ratchet.

25. The swingable door assembly of claim 24 further comprising first and second washers secured on said ratchet pin at spaced distances from said first and second ratchet anchors respectively, said spring means comprising a first compression spring extending between said first washer and said first ratchet anchor and a second compression spring arranged between said second washer and said second ratchet anchor.

26. The swingable door assembly of claim 18 wherein said abutting teeth of said first and second ends of said fixed ratchet and said adjacent ends of said first and second ratchet anchors are constructed to permit rotation of said secured one of said first and second ratchet anchors in a clockwise or counterclockwise direction with respect to said fixed ratchet while preventing rotation in the other direction.

27. The swingable door assembly of claim 18 wherein said preloading means comprises the combination of a torquing key and a receptacle sized and shaped to receive said torquing key arranged in conjunction with said ratchet pin whereby rotation of said torquing key effects rotation of said ratchet pin and second end of said torsion spring.

28. The swingable door assembly of claim 18 wherein said securing means comprises a screw adapted to secure one of said first or second ratchet anchors to said swingable door so that said secured one of said first or second ratchet anchors will rotate relative to said fixed ratchet and the unsecured one of said first and second ratchet anchors upon opening and closing of said swingable door.

29. The swingable door assembly of claim 18 wherein each of said first and second ratchet anchors comprises a receiving port, said screw being arranged within a said receiving port of a selected one of said first or second ratchet anchors.

* * * * *